US008011216B2

(12) United States Patent
Mielonen et al.

(10) Patent No.: US 8,011,216 B2
(45) Date of Patent: Sep. 6, 2011

(54) METHOD AND A STORAGE AND LOCKING ARRANGEMENT FOR STORING KEYS TO LOCKS

(75) Inventors: Pekka Mielonen, Reijola (FI); Oiva Hurskainen, Joensuu (FI); Ahti Kokkonen, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 12/863,693

(22) PCT Filed: Jan. 12, 2009

(86) PCT No.: PCT/FI2009/050016
§ 371 (c)(1),
(2), (4) Date: Nov. 16, 2010

(87) PCT Pub. No.: WO2009/092847
PCT Pub. Date: Jul. 30, 2009

(65) Prior Publication Data

US 2011/0056259 A1 Mar. 10, 2011

(30) Foreign Application Priority Data

Jan. 24, 2008 (FI) ..... 20085057

(51) Int. Cl.
*E05B 11/00* (2006.01)

(52) U.S. Cl. ..... 70/389; 70/337; 70/456 R; 70/429; 292/148

(58) Field of Classification Search ..... 70/63, 388, 70/389, 337–339, 456 R, 386, 408, 429, 390, 70/DIG. 63; 292/148
See application file for complete search history.

(56) References Cited

U.S. PATENT DOCUMENTS 3,906,760 A * 9/1975 Parker, Jr. ..... 70/154
(Continued)

FOREIGN PATENT DOCUMENTS

| | | | |
|---|---|---|---|
| DE | 3905520 | A1 | 8/1990 |
| FR | 2878880 | A1 | 6/2006 |
| FR | 2898932 | A1 | 9/2007 |
| GB | 1500003 | A | 2/1978 |
| WO | 0157344 | A1 | 8/2001 |

OTHER PUBLICATIONS

International Search Report issued in PCT/FI2009/050016, dated Jul. 14, 2009, 4 pages.

*Primary Examiner* — Suzanne Barrett
(74) *Attorney, Agent, or Firm* — Rothwell, Figg, Ernst & Manbeck P.C.

(57) ABSTRACT

A method and storage and locking arrangement for storing keys to locks and controlling the use of keys. The storage and locking arrangement consists of a closed box or a similar storage unit, a central lock and its key, as well as a number of auxiliary locks, each having its designated key. The locks are arranged in a closed box or similar storage unit so that they can be unlocked using keys from the outside of the box. The central lock is arranged to control the operation of the auxiliary locks so that when the central lock is locked, it prevents the keys to the auxiliary locks from being removed from their respective locks, and once the central lock is unlocked, it can be used to select the operation of any single auxiliary lock at a time using the corresponding key so that the key to the auxiliary lock can be removed from the auxiliary lock.

4 Claims, 5 Drawing Sheets

U.S. PATENT DOCUMENTS 3,988,031 A * 10/1976 Meyer ..... 292/153
4,441,348 A * 4/1984 Neilsen ..... 70/389
4,697,443 A * 10/1987 Hillin ..... 70/121
4,723,569 A * 2/1988 Ellis ..... 137/385
4,997,219 A * 3/1991 Carter ..... 292/153
7,000,440 B2 * 2/2006 Martin ..... 70/129
2005/0279145 A1 12/2005 Jensen

* cited by examiner

METHOD AND A STORAGE AND LOCKING ARRANGEMENT FOR STORING KEYS TO LOCKS

CROSS REFERENCE TO RELATED APPLICATION(S)

This application is a 35 U.S.C. 371 National Phase Entry Application from PCT/FI2009/050016, filed Jan. 12, 2009, and designating the United States. This application also claims the benefit of Finnish Patent Application No. 20085057 filed Jan. 24, 2008, the disclosure of which is incorporated herein in its entirety by reference.

BACKGROUND OF THE INVENTION

1. Field of the Invention

The invention is related to a method and arrangement for storing keys to locks and controlling the use of keys through the utilisation of a locking arrangement comprising a number of locks.

2. Background of the Invention

Particularly in lock systems where the locks are arranged to control individual devices, such as parking meters, slot machines, fuel dispensing points etc. that involve access rights and possibly collection of payments perhaps by several different people at certain intervals, a certain problem exists with regard to arranging the use of keys and the control of use appropriately.

The purpose of the invention is to provide a method and a storage and locking arrangement based on the utilisation of a storage box or similar, which makes it simple and efficient to control the use of locks in lock systems referred to in the above by arranging appropriate storage for keys and efficient controls for the use of them.

The objectives of the invention are achieved as described in more detail primarily in the claims.

SUMMARY OF THE INVENTION

According to the invention, locks are arranged in a closed box or similar storage unit so that they can be unlocked using keys from the outside of the box. One of the locks is designated as the central lock and arranged to control the operation of the other locks, known as the auxiliary locks, so that when the central lock is locked, it prevents the keys to the auxiliary locks from being removed from their respective locks, and once the central lock is unlocked, it can be used to select the operation of any single auxiliary lock at a time using its corresponding key so that the key to the auxiliary lock can be removed from the auxiliary lock.

According to the invention, all of the keys are thus visible outside the box, captured in the corresponding locks, and the use of the auxiliary locks is controlled using the central lock and the corresponding key. Control is simple and efficient while only one key to an auxiliary lock can be removed from the box at any given time, releasing it for use elsewhere.

In practice, a preferred solution can be achieved when the locks are cylinder locks equipped with tumbler discs to be turned with a key. In this case the lock cylinder of the central lock, or a bolt element dependent of its rotary movement, controls the turning of the lock cylinders of the auxiliary locks, so that at a certain position of rotation, it allows the use of a selected auxiliary lock.

Possibilities of misuse can be further prevented so that locking an auxiliary lock and removing its key prevents turning any of the lock cylinders of the other locks and thus the removal of the corresponding keys. This also keeps the key to the central lock in the box, making it impossible to use it to allow the other auxiliary locks to be operated and the corresponding keys removed until the removed key has been returned.

Because the selection movement of the locking mechanism in said lock type is based on rotary movement, the auxiliary locks are preferably arranged in an arc around the central lock. The solution is preferable for space utilisation and the design of the control mechanisms.

A storage and locking arrangement according to the invention for storing keys to locks and controlling the use of keys is characterised in that the locks are arranged in a closed box or a similar storage unit so that they can be unlocked using keys from the outside of the box. The central lock is arranged to control the operation of the auxiliary locks so that when the central lock is locked, it prevents the keys to the auxiliary locks from being removed from their respective locks, and once the central lock is unlocked, it can be used to select the operation of any single auxiliary lock at a time using its corresponding key so that the key to the auxiliary lock can be removed from the auxiliary lock.

In a practical preferred embodiment, the locks are cylinder locks equipped with tumbler discs to be turned with a key, and the lock cylinder of the central lock, or a bolt element or similar element dependent of its rotary movement, is arranged to control the turning of the lock cylinders of the auxiliary locks, so that at a certain position of rotation, it allows the use of a selected auxiliary lock. In this case the auxiliary locks are preferably arranged in an arc around the central lock.

In an embodiment of the invention, the bolt element of the central lock is a plate-like piece having a guide slot corresponding to said arc, and the shaped ends of the lock cylinders of the auxiliary locks or bolt elements attached to the lock cylinders are arranged in the slot so that the guide slot normally prevents turning the lock cylinders of the auxiliary locks. The guide slot has an extension section that allows turning the lock cylinder of an auxiliary lock. In this case the central lock is thus arranged to directly affect the auxiliary locks.

In another embodiment of the invention, the bolt element of the central lock is a plate-like piece having a circumferential surface corresponding to said arc which is arranged to interact with the lock cylinders of the auxiliary locks or bolt elements or similar elements attached to the lock cylinders, and which has a circumferential notch arranged to allow turning the lock cylinder of an auxiliary lock. In this case the bolt element of the auxiliary locks is also preferably a plate-like piece having a circumferential surface with a circumferential notch, arranged to interact with the circumferential surface of the bolt element of the central lock through a retainer element arranged between them.

Said retainer element is normally guided by the circumferential surface of the bolt element of the central lock partially into the circumferential notch of the bolt element of an auxiliary lock, and the auxiliary lock to be operated at each time is selected by turning the circumferential notch of the bolt element of the central lock to the position of the appropriate retainer element.

The selection of the desired auxiliary lock can be facilitated by fitting said box with indicator means dependent of the rotary movement of the lock cylinder of the central lock that are arranged to indicate to the outside of the box which one of the auxiliary locks is selected for use at each time.

BRIEF DESCRIPTION OF THE DRAWINGS

In the following, the invention will be described by way of example through reference to the enclosed schematic drawings, in which.

DETAILED DESCRIPTION OF THE INVENTION

Figure 1:
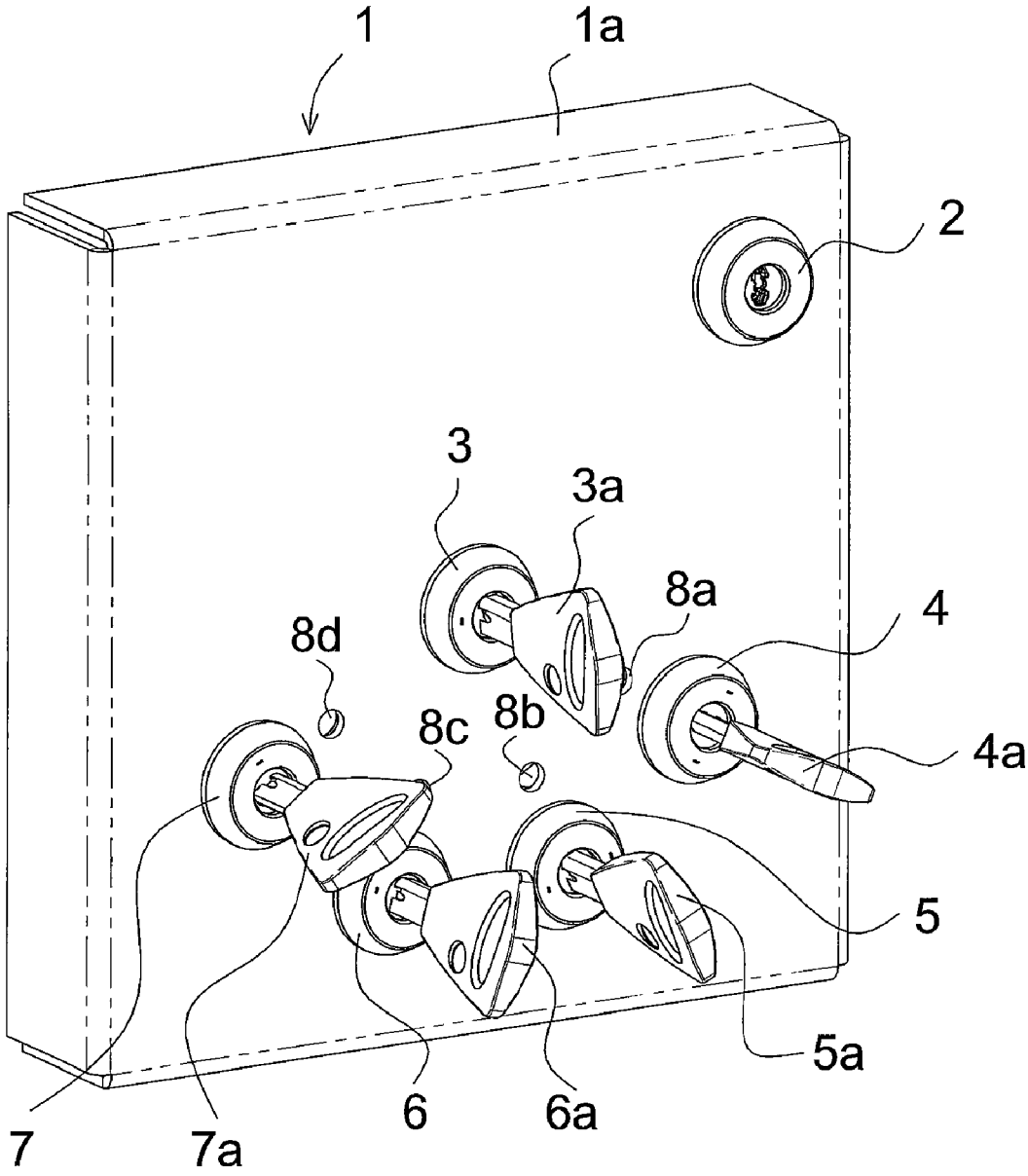
FIG. 1 illustrates a box in a storage and locking arrangement according to the invention viewed from the front.

In the drawings, reference number 1 refers to a closed box intended for the storage of keys, consisting of the box frame 1*a* and a back cover (not shown) which, in the illustrated application, can be attached to the frame 1*a* with a separate lock 2. A central lock 3 with a key 3*a* is attached to the box frame 1*a*, and auxiliary locks 4, 5, 6, and 7 with keys 4*a*, 5*a*, 6*a* and 7*a* are attached around the central lock in an arced pattern.

All of the locks in the illustrated embodiment are prior art cylinder locks equipped with tumblers to be turned with a key, and in the position for inserting and removing the key, the tumbler pack is unaligned. The lock mechanism is unlocked by turning the key from this basic position by the amount of a selection movement that aligns the tumbler pack, releasing the lock cylinder to rotate with the key. At that time, the key cannot be removed from the lock.

Figure 2:
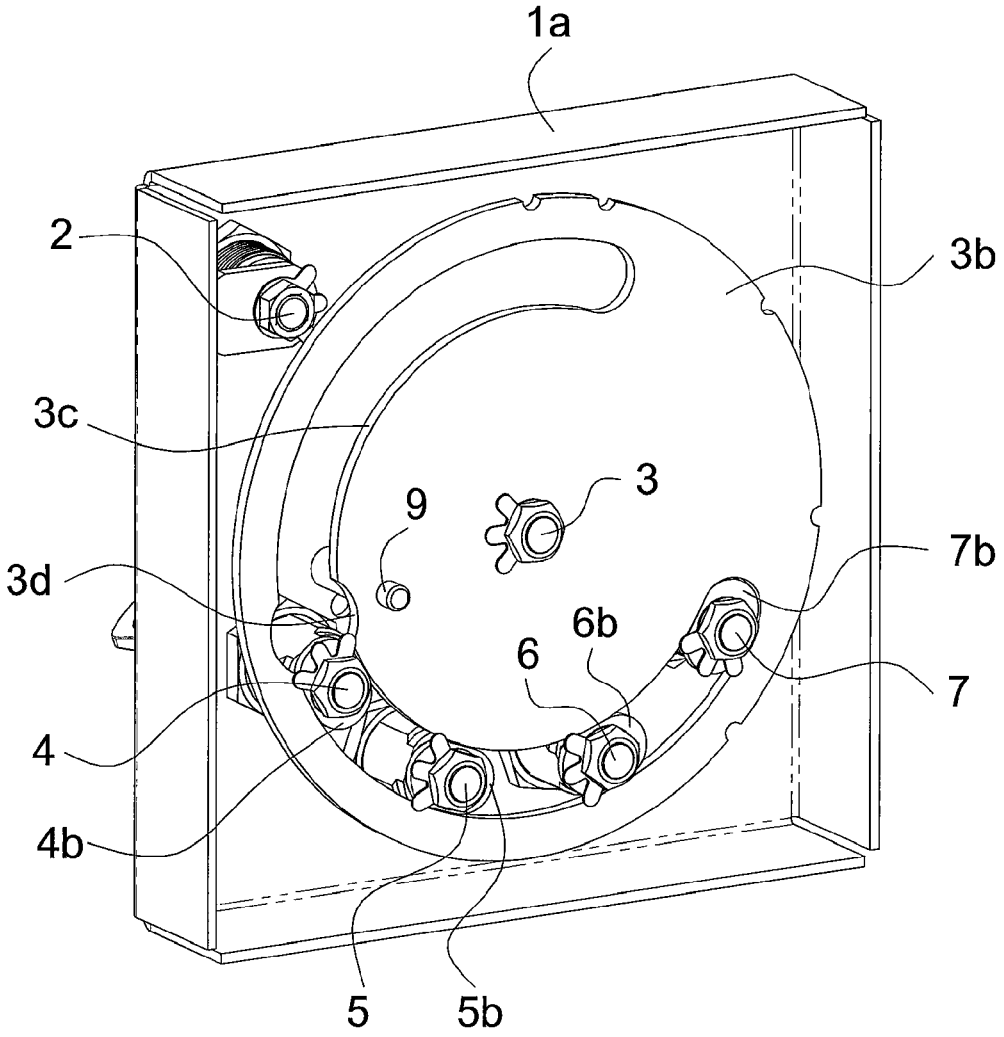
FIG. 2 illustrates a first embodiment of the invention, showing a rear view of the box of FIG. 1 with the locks in a first operating position.
Figure 3:
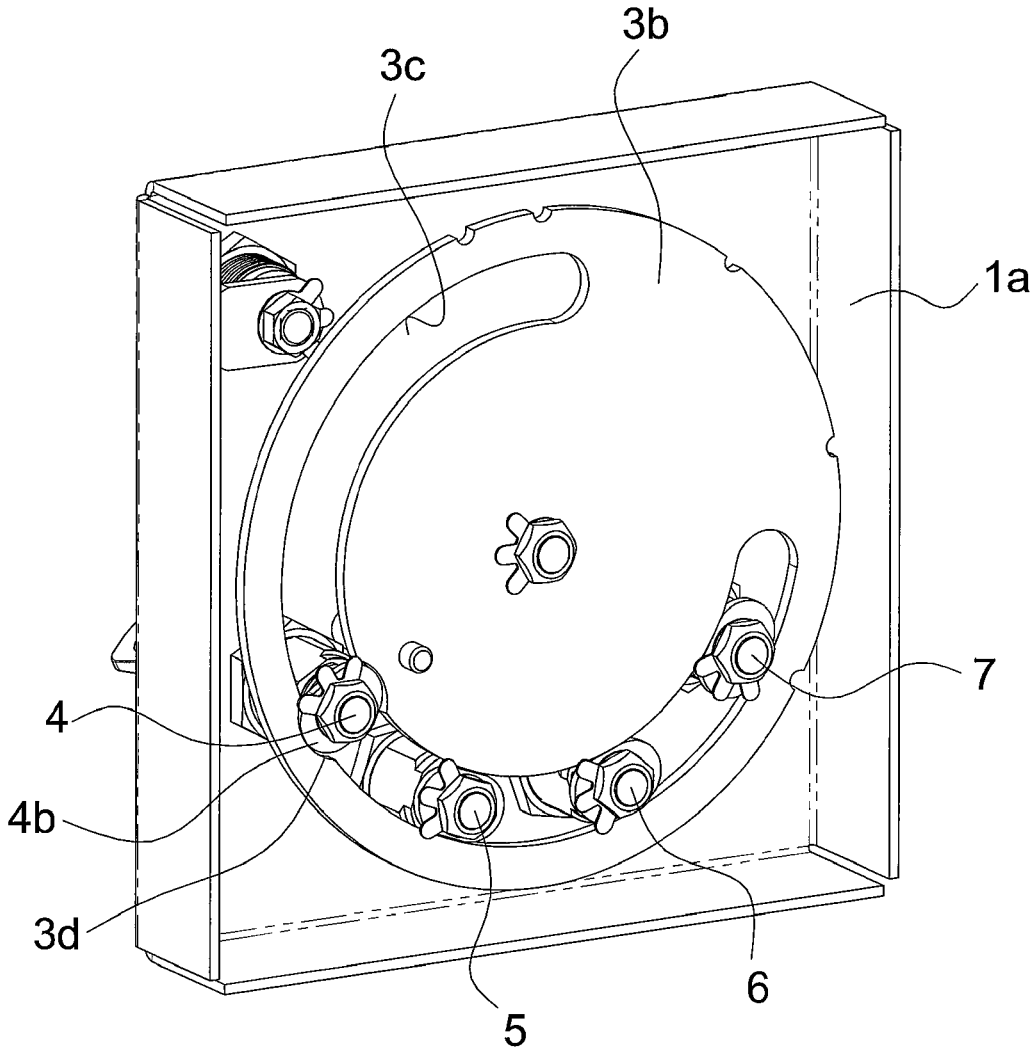
FIG. 3 illustrates the box of FIG. 2 with the locks in a second operating position.
Figure 4:
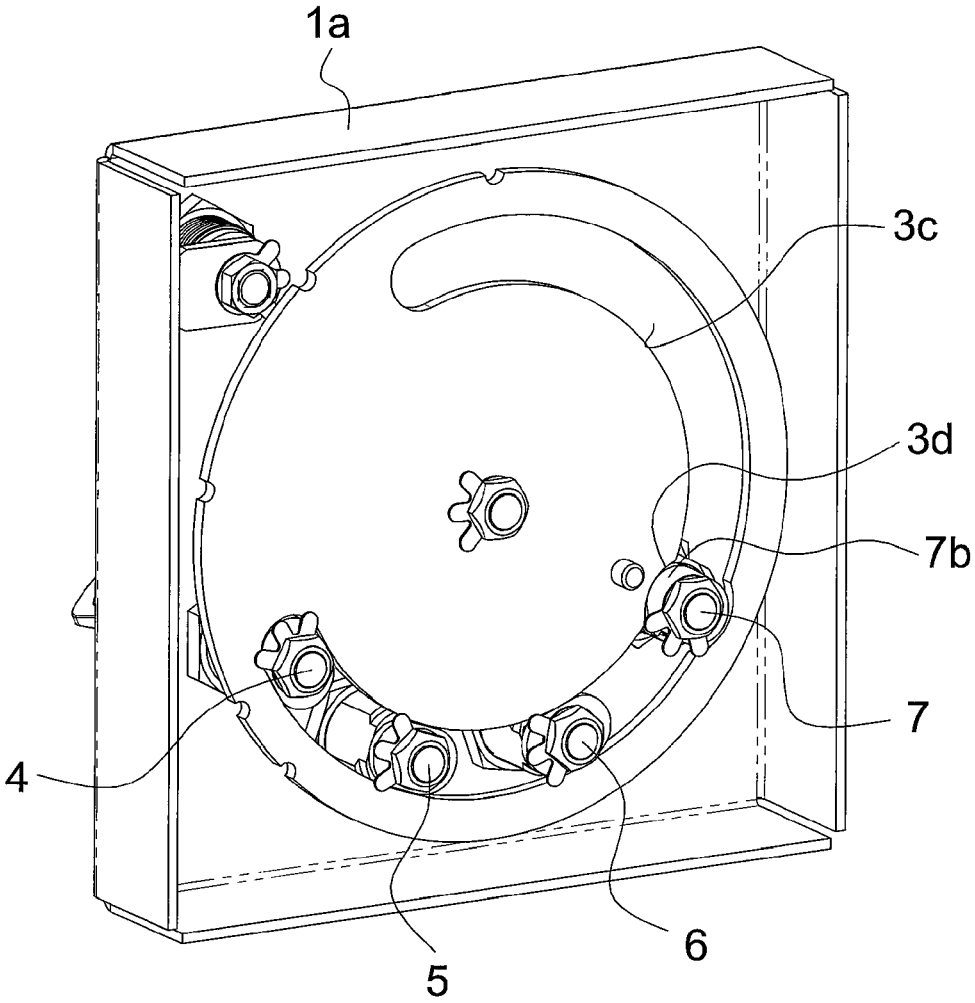
FIG. 4 illustrates the box of FIG. 2 with the locks in a third operating position.

FIGS. 2, 3 and 4 concern the first embodiment, and they show a rear view of the box frame 1*a* of FIG. 1 with the locks in different operating positions. In this embodiment, the central lock 3 is equipped with a disc-like bolt element 3*b* having an arced guide slot 3*c* with an extension section 3*d*. The bolt element 3 turns with the key 3*a* once the locking mechanism of the central lock 3 has been unlocked with the key 3*a*. Correspondingly, the auxiliary locks 4, 5, 6 and 7 have bolt elements 4*b*, 5*b*, 6*b* and 7*b* arranged to interact with the guide slot 3*c* and shaped so that they are normally unable to turn in the guide slot 3*c* as is shown in FIG. 2. When the auxiliary locks are arranged so that their locking mechanisms are in the unlocked position, the keys to the auxiliary locks cannot be turned in their locks, and thus the keys cannot be removed from the locks when the locking mechanism is in this position. Therefore the keys to the auxiliary locks 4*a*, 5*a*, 6*a* and 7*a* are held in the auxiliary locks and are thus securely stored in the box 1.

In FIG. 3, the central lock 3 has been unlocked with its key 3*a*, releasing the lock cylinder (not shown) to turn. In this case, the bolt element 3*b* dependent of the rotary movement of the lock cylinder will also turn when the key is turned further, and in accordance with FIG. 3, it is turned to a position at which its extension section 3*d* is located at the bolt element 4*b* of auxiliary lock 4. In this position, the bolt element 4*d* is allowed to turn when the key 4*a* to auxiliary lock 4 is turned. This allows the auxiliary lock 4 to be locked using its key 4*a*, and the key 4*a* can be removed from the lock for use in another lock independent of the box 1 that has an unlocking code corresponding to the key 4*a*. Because the central lock 3 is unlocked in this position, its key 3*a* cannot be removed from the lock.

In FIG. 4, the central lock 3 has been further turned from the position of FIG. 3 using its key 3*a* to the extent that the extension section 3*d* of the guide slot 3*c* of its bolt element 3*b* is located at auxiliary lock 7. Correspondingly, as a consequence of this, the locking mechanism of auxiliary lock 7 can be turned using its key 7*a* to the locked position, allowing the key 7*a* to be completely removed from the auxiliary lock 7. However, this requires that after the situation of FIG. 3, the key 4*a* to auxiliary lock 4 has been returned and used to unlock the auxiliary lock 4, placing the bolt element 4*b* in a position relative to the guide slot 3*c* that allows the bolt element 3*b* of the central lock to be turned correspondingly in relation to the bolt elements 4*b*, 5*b*, 6*b* and 7*b*.

The box 1 is fitted with indicator means that here comprise openings 8*a*, 8*b*, 8*c* and 8*d* located at each auxiliary lock, as well as a pin, ball or similar element 9 in the bolt element 3*b* of the central lock 3; when located at one of the openings 8*a*, 8*b*, 8*c* and 8*d*, said element 9 indicates that the key to the corresponding auxiliary lock can be taken into use by removing it from its auxiliary lock.

Figure 5:
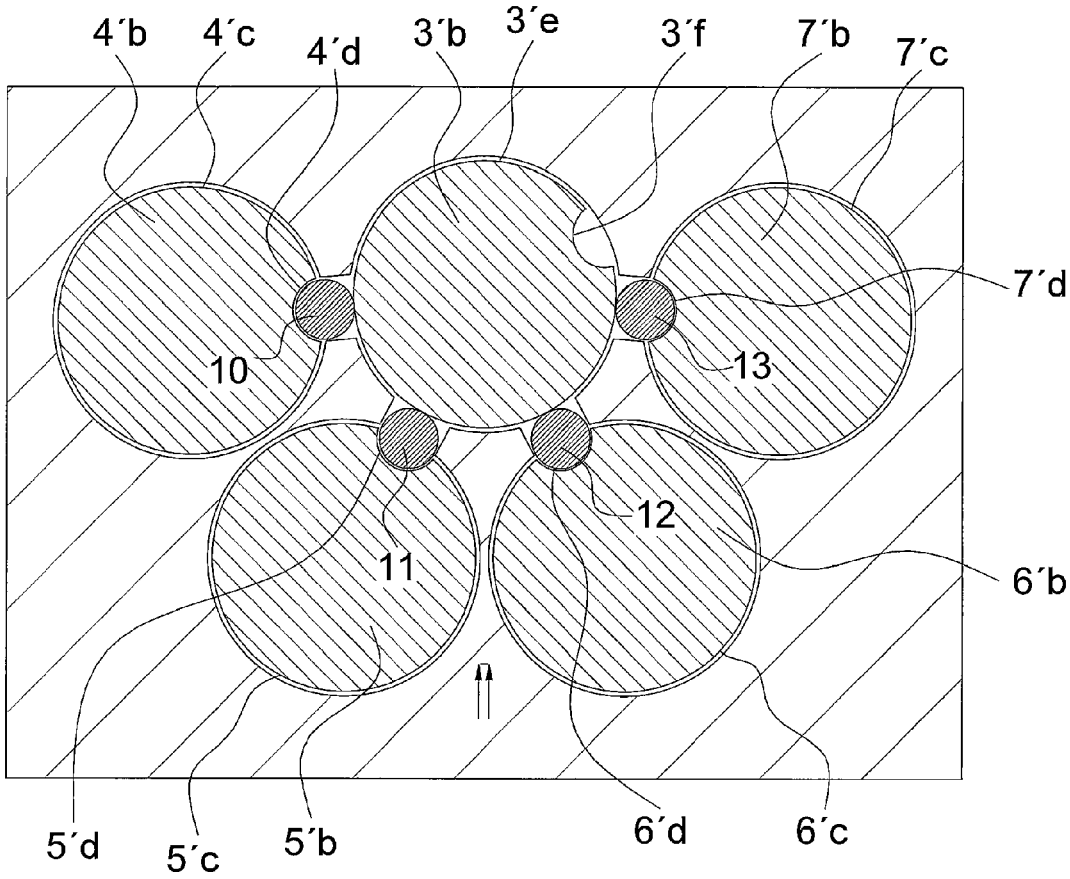
FIG. 5 illustrates a principal diagram of a second embodiment of the invention, showing a rear view of the box of FIG. 1 with the locks in a first operating position.

FIG. 5 illustrates an alternative embodiment as a principal diagram. In this case, the central lock 3 is fitted with a disc-like bolt element 3'*b* having a circumferential surface 3'*e* with a circumferential notch 3'*f*. Correspondingly, the auxiliary locks 4, 5, 6 and 7 have disc-like bolt elements 4'*b*, 5'*b*, 6'*b* and 7'*b* having circumferential surfaces 4'*c*, 5'*c*, 6'*c* and 7'*c* with circumferential notches 4'*d*, 5'*d*, 6'*d* and 7'*d*. This embodiment also includes retainer elements 10, 11, 12 and 13 that normally, when all of the keys are in storage in their respective auxiliary locks in the box 1, are located partially in said circumferential notches 4'*d*, 5'*d*, 6'*d* and 7'*d*, guided by the circumferential surface 3'*e* of the bolt element 3'*b* as shown in FIG. 5. In this case, when it is desired to take one of the keys to the auxiliary locks into use and remove it from the box 1, the key 3*a* is used to turn the circumferential notch 3'*f* of the bolt element 3'*b* of the central lock 3 to the position of the circumferential notch of the appropriate auxiliary lock, allowing the key to the appropriate auxiliary lock to be turned and the key removed from the box 1. Otherwise, operation is analogous to the embodiment of FIGS. 2 to 4. This principal diagram shows a frame part around the bolt elements and retainer elements, the purpose of which is to guide said moving elements as necessary. In practice, guidance can be implemented in many different ways as far as it is necessary.

The control between the central lock and the auxiliary lock can be implemented in many ways deviating from the above description. Instead of a disc-like bolt element and simple rotary movement, a combination of rotary and linear movement can be used, for example. In this case the auxiliary locks are arranged in a row, and their rotation is controlled by a bar or bolt plate fitted with appropriate notches or openings that is controlled by the rotary movement of the central lock. It is also possible to control the auxiliary locks electrically from the central lock. Furthermore, the number of auxiliary locks and consequently the number of keys controlled by a single central lock may vary. For example, the size of the bolt element of the central lock can be increased so that its circumference can accommodate more auxiliary locks with keys. This increases the space requirement correspondingly. Correspondingly, if there are fewer auxiliary locks, for example two locks, two separate extension sections can be arranged in the guide slot of the bolt element of the central lock, allowing a reduction in the rotary movement of the central lock required for selecting each auxiliary lock. Naturally, the invention can also be applied to only one auxiliary lock, the storage of the respective key and the control of its use. The indicator means can also be implemented in different ways.

Thus the invention is not limited to the presented embodiments but several variations can be conceived within the scope of the associated claims.

The invention claimed is:

1. A storage and locking arrangement for storing keys to locks and controlling the use of keys, comprising:

a closed box, a central lock and a key for the central lock, as well as a number of auxiliary locks, each auxiliary lock having a designated key whereby the locks are cylinder locks arranged in the closed box so that they can be unlocked using keys from outside of the box, and wherein the lock cylinder of the central lock includes a bolt element configured to rotate with the lock cylinder of the central lock, wherein the bolt element is arranged to control the turning of the lock cylinders of the auxiliary locks so that when the central lock is locked, the bolt element prevents the keys to the auxiliary locks from being removed from their respective locks, and that once the central lock is unlocked, the bolt element is arranged to allow at selected positions of rotation the operation of any single auxiliary lock at a time using the corresponding key to the auxiliary lock so that the key to the auxiliary lock can be removed from the auxiliary lock, wherein the auxiliary locks are arranged in an arc around the central lock, and the bolt element is a plate-like piece having a guide slot corresponding to said arc, and wherein shaped ends of the lock cylinders of the auxiliary locks or bolt elements attached to the lock cylinders of the auxiliary locks are arranged in the guide slot so that the guide slot normally prevents turning the lock cylinders of the auxiliary locks, and wherein the guide slot has an extension section that allows turning the lock cylinder of an auxiliary lock.

2. A storage and locking arrangement according to claim 1, wherein the cylinder locks are equipped with tumbler discs to be turned with a key.

3. A storage and locking arrangement according to claim 2, wherein locking an auxiliary lock and removing its key is arranged to prevent turning any of the lock cylinders of the other locks and thus prevent the removal of the corresponding keys of the other locks.

4. A storage and locking arrangement according to claim 1, wherein said box is fitted with indicator means dependent of the rotary movement of the lock cylinder of the central lock that are arranged to indicate to the outside of the box which one of the auxiliary locks is selected for use at each time.

* * * * *